US009360795B2

(12) United States Patent
Kang et al.

(10) Patent No.: US 9,360,795 B2
(45) Date of Patent: Jun. 7, 2016

(54) METHOD OF SUPPLYING DEVELOPING UNIT WITH TONER AND IMAGE FORMING APPARATUS USING THE SAME

(71) Applicant: Samsung Electronics Co., Ltd., Suwon-si (KR)

(72) Inventors: Bum-Kwon Kang, Seoul (KR); Chun-sub Ryu, Yongin-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/485,159

(22) Filed: Sep. 12, 2014

(65) Prior Publication Data

US 2015/0078766 A1 Mar. 19, 2015

(30) Foreign Application Priority Data

Sep. 13, 2013 (KR) ..... 10-2013-0110627

(51) Int. Cl.
*G03G 15/08* (2006.01)

(52) U.S. Cl.
CPC ..... *G03G 15/0831* (2013.01); *G03G 15/0834* (2013.01); *G03G 15/0868* (2013.01)

(58) Field of Classification Search
CPC ..... G03G 15/0822; G03G 15/0834; G03G 15/0865; G03G 15/0868; G03G 2215/0685
See application file for complete search history.

(56) References Cited

U.S. PATENT DOCUMENTS 5,950,036 A * 9/1999 Konishi ..... 399/8
5,966,555 A * 10/1999 Nakajima et al. ..... 399/18
7,161,696 B2 * 1/2007 Yamamoto et al. ..... 358/1.15
7,538,918 B2 * 5/2009 Oki ..... 358/521
8,861,994 B2 * 10/2014 Ishii ..... 399/27
2003/0133722 A1 * 7/2003 Kaiho ..... 399/27
2004/0136025 A1 * 7/2004 Moriyama et al. ..... 358/1.14
2008/0055637 A1 * 3/2008 Hatakeyama ..... G03G 15/65 358/1.15
2011/0052242 A1 * 3/2011 Kamata ..... G03G 15/5016 399/82
2011/0255127 A1 * 10/2011 Suzuki ..... 358/1.15
2012/0076523 A1 * 3/2012 Kojima ..... 399/70
2013/0230332 A1 * 9/2013 Ishii ..... 399/27
2013/0243450 A1 * 9/2013 Suenami ..... 399/27

FOREIGN PATENT DOCUMENTS

| | | |
|---|---|---|
| JP | 2008-213304 | 9/2008 |
| JP | 2009-080170 | 4/2009 |
| JP | 2010-145914 | 7/2010 |
| JP | 2011-059399 | 3/2011 |
| KR | 10-2008-0065503 | 7/2008 |

* cited by examiner

*Primary Examiner* — David Gray
*Assistant Examiner* — Carla Therrien
(74) *Attorney, Agent, or Firm* — Staas & Halsey LLP

(57) ABSTRACT

A method of supplying a developing unit with toner and an image forming apparatus using the method are provided. The method may include supplying toner to a developing unit separate from a toner bottle in an image forming apparatus. The method includes: detecting a remaining amount of toner in the developing unit during printing; comparing the remaining amount of toner with a first reference value; if the remaining amount of toner is greater than the first reference value, continuing printing; and if the remaining amount of toner is not greater than the first reference value, determining whether to supply toner based on a preset mode. Deterioration of printing quality in a toner supply mode may be markedly reduced according to a user's settings.

8 Claims, 10 Drawing Sheets

METHOD OF SUPPLYING DEVELOPING UNIT WITH TONER AND IMAGE FORMING APPARATUS USING THE SAME

CROSS-REFERENCE TO RELATED APPLICATIONS

This application claims the priority benefit of Korean Patent Application No. 10-2013-0110627, filed on Sep. 13, 2013, in the Korean Intellectual Property Office, the disclosure of which is incorporated herein in its entirety by reference.

BACKGROUND

1. Field

One or more embodiments relate to supply of toner in an image forming apparatus, and more particularly, to a method of supplying toner to a developing unit in an image forming apparatus in consideration of printing quality and speed, and an image forming apparatus capable of supplying toner to a developing unit in consideration of printing quality and speed.

2. Description of the Related Art

An image forming apparatus in which a developing unit and a toner bottle are separate from each other may enter a toner supply mode to supply toner from the toner bottle to the developing unit if it is detected that toner filled in the developing unit is used up.

FIG. 1 is a flowchart illustrating operations for supplying toner to a developing unit in an image forming apparatus during printing. First, the image forming apparatus is operated in print mode (operation S100). Then, the remaining amount of toner in the developing unit is detected using a sensor (operation S110), and it is determined whether to supply toner to the developing unit (operation S120). If it is determined to supply toner, printing is suspended (operation S130), and the image forming apparatus enters a toner supply mode to supply toner from the toner bottle to the developing unit (operation S140).

However, the following problems may arise. The toner supply mode may start in the middle of printing if the sensor detects that the developing unit has used up the toner. That is, printing has to be suspended to supply toner, and thus printing quality may be lowered.

Particularly, if high-coverage images are printed, toner filled in the developing unit may be quickly used up, and thus the image forming apparatus may frequently enter the toner supply mode. This may lower the quality of printing.

SUMMARY

One or more embodiments include a method of supplying toner to a developing unit in an image forming apparatus in consideration of printing quality, printing speed, and user's settings, so as to minimize deterioration of printing performance in a toner supply mode.

One or more embodiments include an image forming apparatus capable of supplying toner to a developing unit in consideration of printing quality and speed.

According to one or more embodiments, there is provided a method of supplying toner to a developing unit separate from a toner bottle in an image forming apparatus, the method may include detecting a remaining amount of toner in the developing unit during printing so as to compare the remaining amount of toner with a first reference value; and if the remaining amount of toner is greater than the first reference value, continuing printing, and if the remaining amount of toner is not greater than the first reference value, determining whether to supply toner based on a preset mode.

The preset mode may include an initially set mode of the image forming apparatus or a mode set by a user.

When the remaining amount of toner is not greater than the first reference value, the preset mode may include a quality mode for supplying toner to the developing unit or a speed mode for continuing printing without supplying toner to the developing unit.

The method may further include: determining whether the remaining amount of toner detected by a sensor may be not greater than a second reference value that is smaller than the first reference value; and if the remaining amount of toner detected by the sensor is not greater than the second reference value, suspending printing and supplying toner.

The method may further include: if a printing mode of the image forming apparatus is set to a speed mode in which printing may be continued without supplying toner, displaying a printing mode switch button through which the printing mode of the image forming apparatus is changeable to a quality mode for supplying toner; and if the printing mode switch button is selected, suspending printing and supplying toner to the developing unit.

The method may further include: displaying a switch-to-speed-mode button on a user interface screen; and if the switch-to-speed-mode button is selected, suspending supply of toner to the developing unit and restarting printing.

According to one or more embodiments, there is provided a method of supplying toner to a developing unit separate from a toner bottle in an image forming apparatus, the method may include calculating an amount of toner necessary for each sheet of paper; calculating a time for entering a toner supply mode and an estimated printing delay time based on a remaining amount of toner in the developing unit and the calculated amount of toner for each sheet of paper; displaying the calculated time for entering the toner supply mode or a number of sheets of paper to be used until the calculated time for entering the toner supply mode, and the estimated printing delay time, on at least one of a screen of a user interface unit of the image forming apparatus and a driver screen of a user's personal computer (PC); displaying a button for selecting one of a speed mode in which printing is continued without additionally supplying toner and a quality mode in which toner is supplied, on at least one of the screen of the user interface unit of the image forming apparatus and the driver screen of the user's PC; detecting the remaining amount of toner in the developing unit during printing so as to compare the detected remaining amount of toner with a first reference value; and if the detected remaining amount of toner is greater than the first reference value, continuing printing, and if the detected remaining amount of toner is not greater than the first reference value, determining whether to supply toner to the developing unit based on a preset mode.

The preset mode may include an initially set mode of the image forming apparatus or a mode set by a user.

The method may further include: determining whether the remaining amount of toner detected by a sensor is not greater than a second reference value that is smaller than the first reference value; and if the remaining amount of toner detected by the sensor is not greater than the second reference value, suspending printing and supplying toner.

The method may further include: if a printing mode of the image forming apparatus is set to the speed mode, displaying a printing mode switch button through which the printing mode of the image forming apparatus is changeable to the quality mode; and if the printing mode switch button is selected, suspending printing and supplying toner to the developing unit.

The method may further include: displaying a switch-to-speed-mode button on the screen of the user interface unit; and if the switch-to-speed-mode button is selected, suspending supply of toner to the developing unit and restarting printing.

According to one or more embodiments, there is provided an image forming apparatus which may include an image forming unit configured to form images on printing media; a toner bottle disposed in the image forming unit; a developing unit separate from the toner bottle and configured to receive toner from the toner bottle for developing images; a user interface unit which provides a user interface; and a control unit configured to compare a remaining amount of toner in the developing unit with a first reference value, wherein if the remaining amount of toner in the developing unit is greater than the first reference value, the control unit signals the image forming unit to continue printing, and if the remaining amount of toner in the developing unit is not greater than the first reference value, the control unit determines whether to supply toner based on a preset mode.

The control unit may determine whether the remaining amount of toner in the developing unit is not greater than a second reference value that is smaller than the first reference value, and if the remaining amount of toner of the developing unit is not greater than the second reference value, the control unit may signal the image forming unit to suspend printing to supply toner to the developing unit.

The image forming apparatus may further include a printing mode storage unit storing information about printing mode settings, wherein if a speed mode is stored in the printing mode storage unit as a set mode, the user interface unit may display a switch-to-quality-mode button to allow switching to the quality mode, and if the switch-to-quality-mode button displayed on the user interface unit is selected, the control unit suspends printing to supply toner to the developing unit.

The user interface unit may display a switch-to-speed-mode button, and if the switch-to-speed-mode button is selected, the control unit may suspend supply of toner to the developing unit to restart printing.

The control unit may calculate an amount of toner necessary for each sheet of paper, a time for entering a toner supply mode, and a number of sheets of paper to be used for printing with the remaining amount of toner in the developing unit based on the remaining amount of toner in the developing unit and the calculated amount of toner necessary for each sheet of paper, and the control unit may display the calculated time for entering the toner supply mode and the number of sheets of paper on the user interface unit.

The control unit may calculate an amount of toner necessary for each sheet of paper and then may calculate a printing delay time based on the remaining amount of toner in the developing unit and the calculated amount of toner necessary for each sheet of paper, and the control unit may display the printing delay time on the user interface unit.

The user interface unit may display a button through which one of a quality mode for supplying toner and a speed mode for continuing printing without supplying toner is selectable.

If a number of sheets of paper used for printing in a speed mode is equal to or greater than a predetermined value, the control unit may supply toner to the developing unit.

The control unit may calculate an amount of toner used in a speed mode, and if the amount of toner used in the speed mode is equal to or greater than a predetermined value, the control unit may supply toner to the developing unit.

If the remaining amount of toner in the developing unit during operation in a speed mode is equal to or smaller than a predetermined value, the control unit may supply toner to the developing unit.

In an aspect of one or more embodiments, there is provided at least one non-transitory computer readable medium storing computer readable instructions which when executed implement methods of one or more embodiments.

BRIEF DESCRIPTION OF THE DRAWINGS

These and/or other aspects will become apparent and more readily appreciated from the following description of embodiments, taken in conjunction with the accompanying drawings in which.

DETAILED DESCRIPTION

Figure 1:
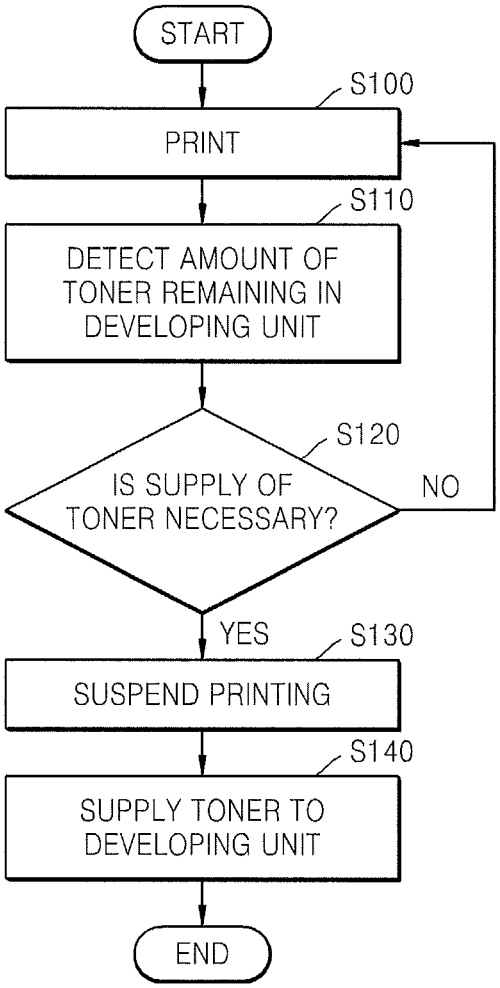
FIG. 1 PRIOR ART
FIG. 1 is a flowchart illustrating operations for supplying toner to a developing unit in an image forming apparatus during printing.

Reference will now be made in detail to embodiments, examples of which are illustrated in the accompanying drawings, wherein like reference numerals refer to like elements throughout. In this regard, embodiments may have different forms and should not be construed as being limited to the descriptions set forth herein. Accordingly, embodiments are merely described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list.

Figure 2:
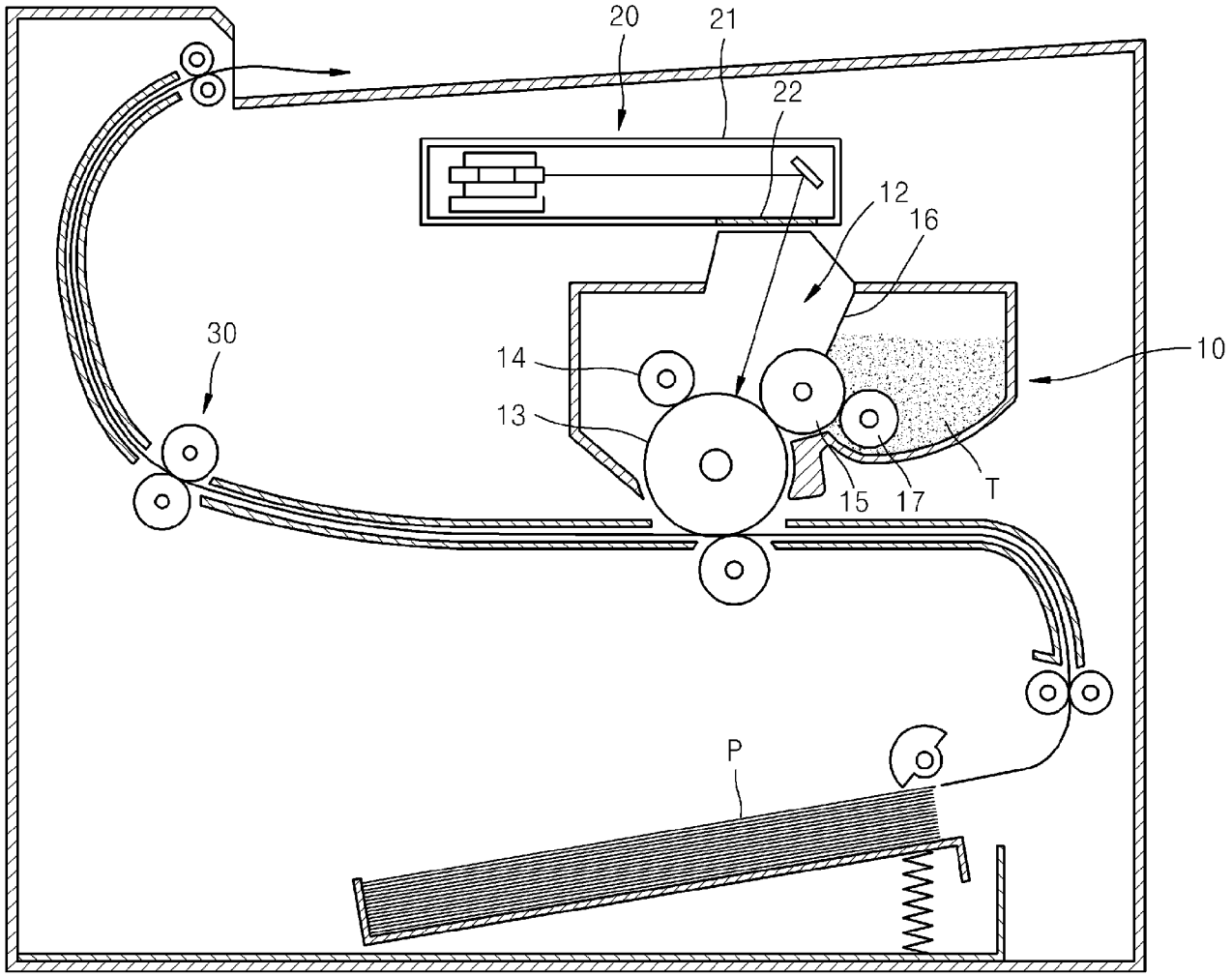
FIG. 2 is a view illustrating an image forming apparatus in which a toner bottle and a developing unit are separate from each other according to an embodiment.

FIG. 2 is a view illustrating an image forming apparatus in which a toner bottle and a developing unit 10 are separate from each other according to an embodiment. Referring to FIG. 2, the image forming apparatus includes the developing unit 10 and an exposing unit 20. The developing unit 10 includes a photoconductor 13 configured to form an electrostatic latent image thereon, a charging roller 14 configured to charge the photoconductor 13 to a predetermined voltage, a developing roller 15 configured to supply toner T being a powder-type developer to an electrostatic latent image formed on the photoconductor 13 for developing the electrostatic latent image, a doctor blade 16 making contact with the developing roller 15 to regulate the amount of toner T on the developing roller 15, and a supply roller 17 configured to supply toner T to the developing roller 15. The listed parts of the developing unit 10 are disposed in a housing 11.

Figure 3:
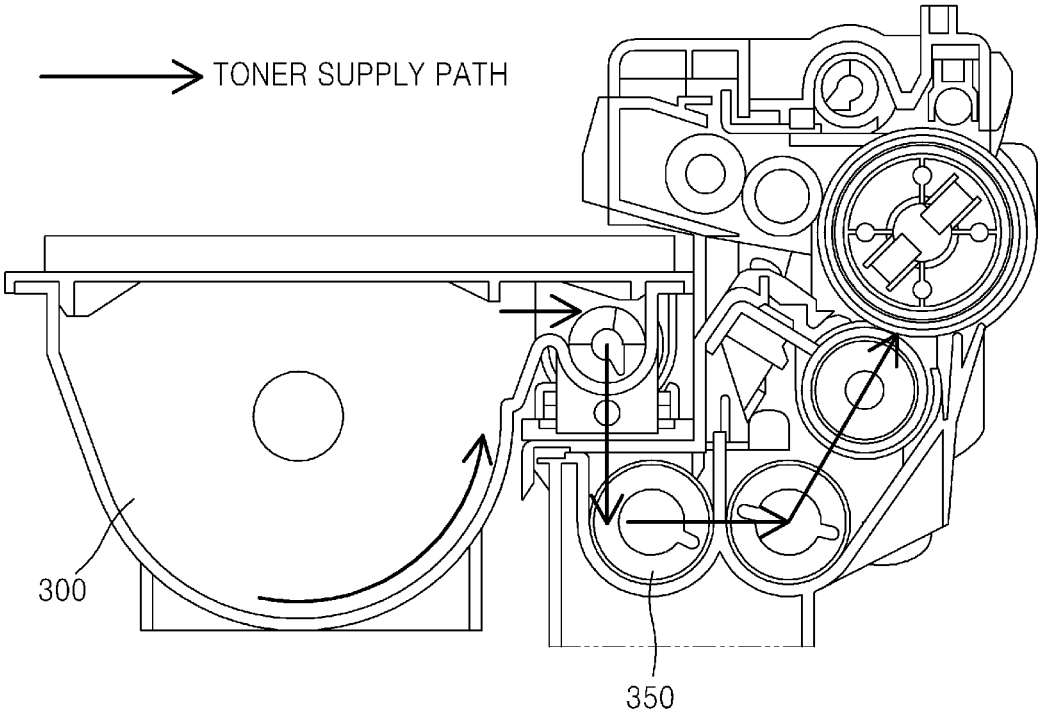
FIG. 3 is a view illustrating an image forming system in which a developing unit and a toner bottle are separate from each other.

FIG. 3 is a view illustrating an image forming system including a toner bottle 300 and a developing unit 350 that are separate from each other. The toner bottle 300 stores toner to be used for forming images in an image forming apparatus. The developing unit 350 is used to form images on an organic photoconductor (OPC), and if the developing unit 350 uses up toner, the toner bottle 300 supplies toner to the developing unit 350.

Figure 4:
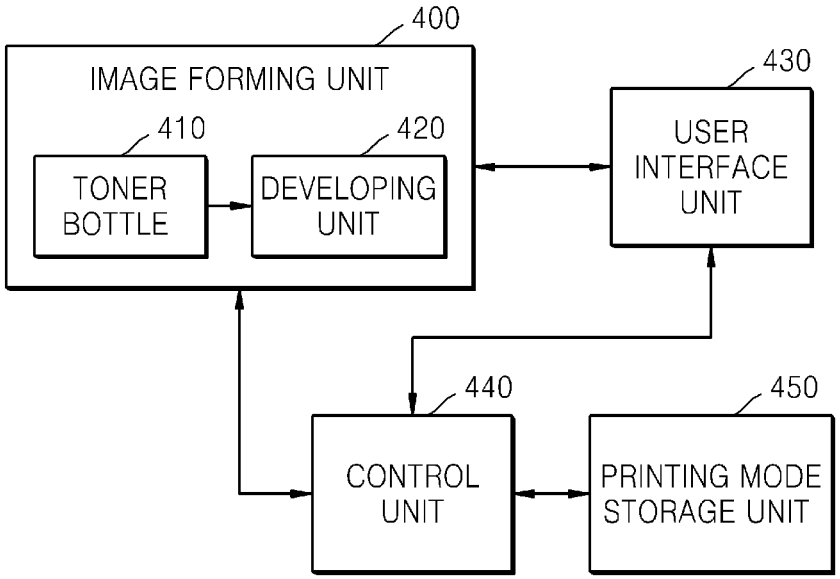
FIG. 4 is a block diagram illustrating an image forming apparatus in which toner is supplied to a developing unit in consideration of printing quality and speed according to an embodiment.

FIG. 4 is a block diagram illustrating an image forming apparatus in which toner is supplied to a developing unit 420 in consideration of printing quality and speed according to an embodiment.

In the image forming apparatus of the current embodiment, toner is supplied to the developing unit 420 from a toner bottle 410 separated from the developing unit 420. The image forming apparatus includes an image forming unit 400, the toner bottle 410, the developing unit 420, a user interface unit 430, and a control unit 440.

The image forming unit 400 is used to form images on printing media. The toner bottle 410 stores toner so as to supply the toner to the developing unit 420. The developing unit 420 receives toner from the toner bottle 410 and develops images using the toner. The user interface unit 430 may provide interfaces such as a touch screen to users.

The control unit 440 determines whether the amount of toner remaining in the developing unit 420 is greater than a first reference value, and if it is determined that the remaining amount is greater than the first reference value, the control unit 440 signals the image forming unit 400 to continue printing.

If the remaining amount of toner is not greater than the first reference value, the control unit 440 determines whether to supply toner to the toner bottle 410 based on a preset mode. For example, when the remaining amount of toner is not greater than the first reference value, the preset mode may be a quality mode (toner is supplied to the developing unit 420) or may be a speed mode (printing is continued without supplying toner to the developing unit 420). The preset mode may be an initial default mode of the image forming apparatus or a mode set by a user. The control unit 440 determines whether the printing mode of the image forming apparatus is set to a speed mode in which printing speed has priority over printing quality, and if so, the printing is continued under the control of the control unit 440.

In addition, the control unit 440 determines whether the remaining amount of toner in the developing unit 420 is equal to or smaller than a second reference value that is lower than the first reference value, and if so, the control unit 440 signals the image forming unit 400 to suspend printing for supplying toner to the developing unit 420.

In one or more embodiments, the image forming apparatus may include a printing mode storage unit 450, and the printing mode storage unit 450 may store information about the printing mode of the image forming apparatus.

For example, if the speed mode is stored in the printing mode storage unit 450 as a set mode, the user interface unit 430 displays a switch-to-quality-mode button so that a user may switch the printing mode from the speed mode to the quality mode in which printing quality has priority over printing speed.

If the switch-to-quality-mode button on the user interface unit 430 is selected, the control unit 440 suspends printing and supplies toner to the developing unit 420.

While toner is supplied to the developing unit 420, the user interface unit 430 displays a switch-to-speed-mode button, and if the switch-to-speed-mode button is selected, the control unit 440 suspends supplying of the toner and restarts printing.

In addition, the control unit 440 may calculate the amount of toner necessary for printing on a sheet of paper so as to determine a time for entering a toner supply mode and the number of sheets of paper to be used for printing with the remaining amount of toner in the developing unit 420 based on the remaining amount of toner and the calculated amount of toner for a sheet of paper. Then, the user interface unit 430 may display the time for entering the toner supply mode and the number of sheets of paper to be used.

In this case, the control unit 440 may calculate the amount of toner necessary for printing on a sheet of paper and may estimate a printing delay time based on the remaining amount of toner in the developing unit 420 and the calculated amount of toner for a sheet of paper. Then, the control unit 440 may signal the user interface unit 430 to display the estimated printing delay time.

Figure 10:
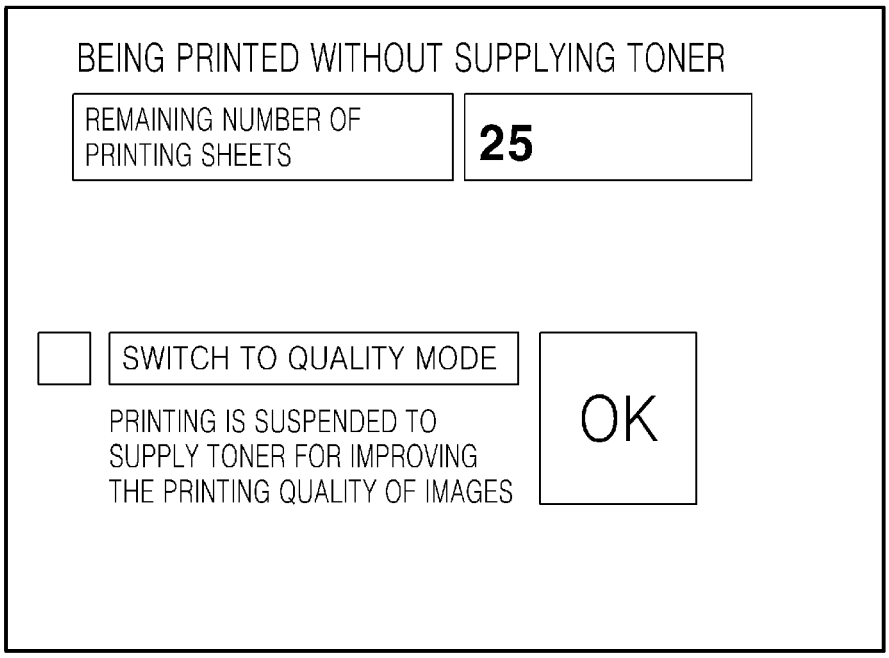
FIG. 10 illustrates an exemplary user interface screen displaying a switch-to-quality-mode button when speed mode is already set.

In addition, as shown in FIG. 10, if printing quality is lowered, the user interface unit 430 may display a button for supplying toner so that a user may select the button for supplying toner. In this case, a relatively small amount of toner may be supplied as compared with the amount of toner supplied in the quality mode, or a toner supply time period may be shorter than a toner supply time period in the quality mode. Printed paper sheets may be checked with the naked eye in the speed mode, and a user may determine whether to continue printing in the speed mode.

In one or more embodiments, printing of the image forming apparatus may be directly controlled through a user interface screen such as a display user interface (UI) screen, or may be remotely controlled by selecting the quality mode or the speed mode from a distance.

A remote control personal computer (PC) capable of remotely controlling the image forming apparatus may be used for remotely controlled operations. Alternatively, a user may control printing by remotely selecting the quality mode or the speed mode by using a driver or a control panel of a host device capable of receiving printing data.

In one or more embodiments, although printing is completed in the speed mode, the image forming apparatus may be further operated to supply toner from the toner bottle 410 to the developing unit 420 to an approximate level for fast printing in the next print job.

As shown in FIG. 10, if the number of sheets of printed paper in the speed mode is equal to or greater than a predetermined value, the control unit 440 controlling the developing unit 420 of the image forming apparatus may automatically switch the printing mode to the toner supply mode for the purpose of maintaining printing quality.

Alternatively, the control unit 440 may calculate the amount of toner used in the speed mode, and if the calculated amount of toner is equal to or greater than a predetermined value, the control unit 440 may switch the printing mode to the toner supply mode.

Alternatively, if a toner detection unit detects that the amount of toner remaining in the developing unit 420 in the speed mode is not greater than a predetermined value, the control unit 440 may switch the printing mode to the toner supply mode.

As described above, the printing mode may be switched from the speed mode to the quality mode in a forced automatic manner to supply toner. The reason for this is so as not to lower printing quality or to obtain a hard-to-read or non-usable printout which may occur if a large number of sheets of paper are continuously used for printing in the speed mode.

The user interface unit 430 may display a button through which a user may select the speed mode to prioritize speed over quality and continue printing without toner being supplied or the quality mode to prioritize quality over speed and supply toner after suspending printing.

For example, as shown in FIG. 10, if printing quality is lowered, the user interface unit 430 may display a button for supplying toner so that a user may select the button for supplying the toner. In this case, a relatively small amount of toner may be supplied as compared with the amount of toner supplied in the quality mode, or a toner supply time period may be shorter than a toner supply time period in the quality mode. Printed paper sheets may be checked with the naked eye in the speed mode, and a user may determine whether to continue printing in the speed mode.

In one or more embodiments, printing by the image forming apparatus may be directly controlled through a screen of the user interface unit 430 such as a display user interface (UI) screen, or may be remotely controlled by selecting the quality mode or the speed mode from a distance.

A remote control PC capable of remotely controlling the image forming apparatus may be used for remotely controlled operations. Alternatively, a user may control printing by remotely selecting the quality mode or the speed mode by using a driver or a control panel of a host device capable of receiving printing data.

In one or more embodiments, although printing is completed in the speed mode, the image forming apparatus may be further operated to supply toner from the toner bottle 410 to the developing unit 420 to an approximate level for fast printing in the next print job.

As shown in FIG. 10, the control unit 440 controlling the developing unit 420 may count the number of sheets of printed paper in the speed mode, and if the counted number of sheets of printed paper is equal to or greater than a predetermined value, the control unit 440 may automatically switch the printing mode to the toner supply mode for the purpose of maintaining printing quality.

In addition, the control unit 440 may calculate the amount of toner used in the speed mode, and if the calculated amount of toner is equal to or greater than a predetermined value, the control unit 440 may switch the printing mode to the toner supply mode.

Alternatively, if a toner detection sensor detects that the amount of toner remaining in the developing unit 420 in the speed mode is not greater than a predetermined value, the control unit 440 may switch the printing mode to the toner supply mode.

As described above, the printing mode may be switched from the speed mode to the quality mode in a forced automatic manner to supply toner. The reason for this is so as not to lower printing quality or to obtain a hard-to-read or non-usable printout which may occur if a large number of sheets of paper are continuously used for printing in the speed mode.

Figure 5:
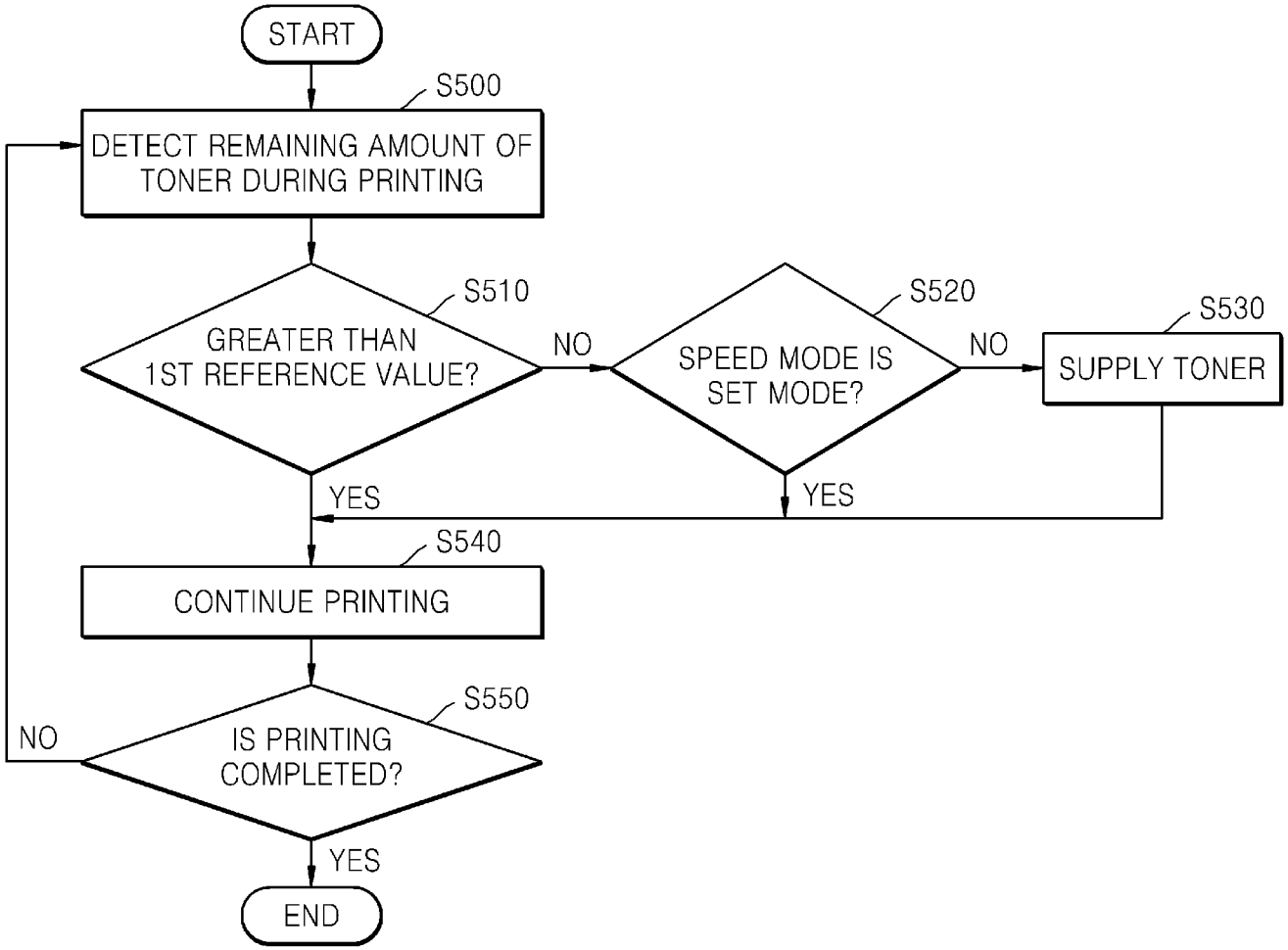
FIG. 5 is a flowchart illustrating a method of supplying toner to a developing unit in an image forming apparatus in consideration of printing quality and speed according to an embodiment.

FIG. 5 is a flowchart illustrating a method of supplying toner to a developing unit in an image forming apparatus in consideration of printing quality and speed according to an embodiment. Referring to FIG. 5, in the method of supplying toner to the developing unit separate from the toner bottle, the amount of toner remaining in the developing unit is detected (operation S500).

The remaining amount of toner is compared with a first reference value (operation S510). If the remaining amount of toner is greater than the first reference value, printing is continued (operation S540), and if the remaining amount of toner is not greater than the first reference value, it is determined whether to supply toner based on a preset mode. For example, when the remaining amount of toner is not greater than the first reference value, the preset mode may be a quality mode (toner is supplied to the developing unit) or may be a speed mode (printing is continued without supplying toner to the developing unit). The preset mode may be an initial default mode of the image forming apparatus or a mode set by a user.

For example, if the remaining amount of toner is not greater than the first reference value, it is determined whether the printing mode of the image forming apparatus is set to the speed mode to prioritize printing speed over printing quality (operation S520).

If the printing mode of the image forming apparatus is not set to the speed mode, printing is suspended to supply toner to the developing unit (operation S530), and then printing is restarted (operation S540).

On the other hand, if the printing mode of the image forming apparatus is set to the speed mode, printing is continued (operation S540). In this manner, printing is completed (operation S550).

Figure 6:
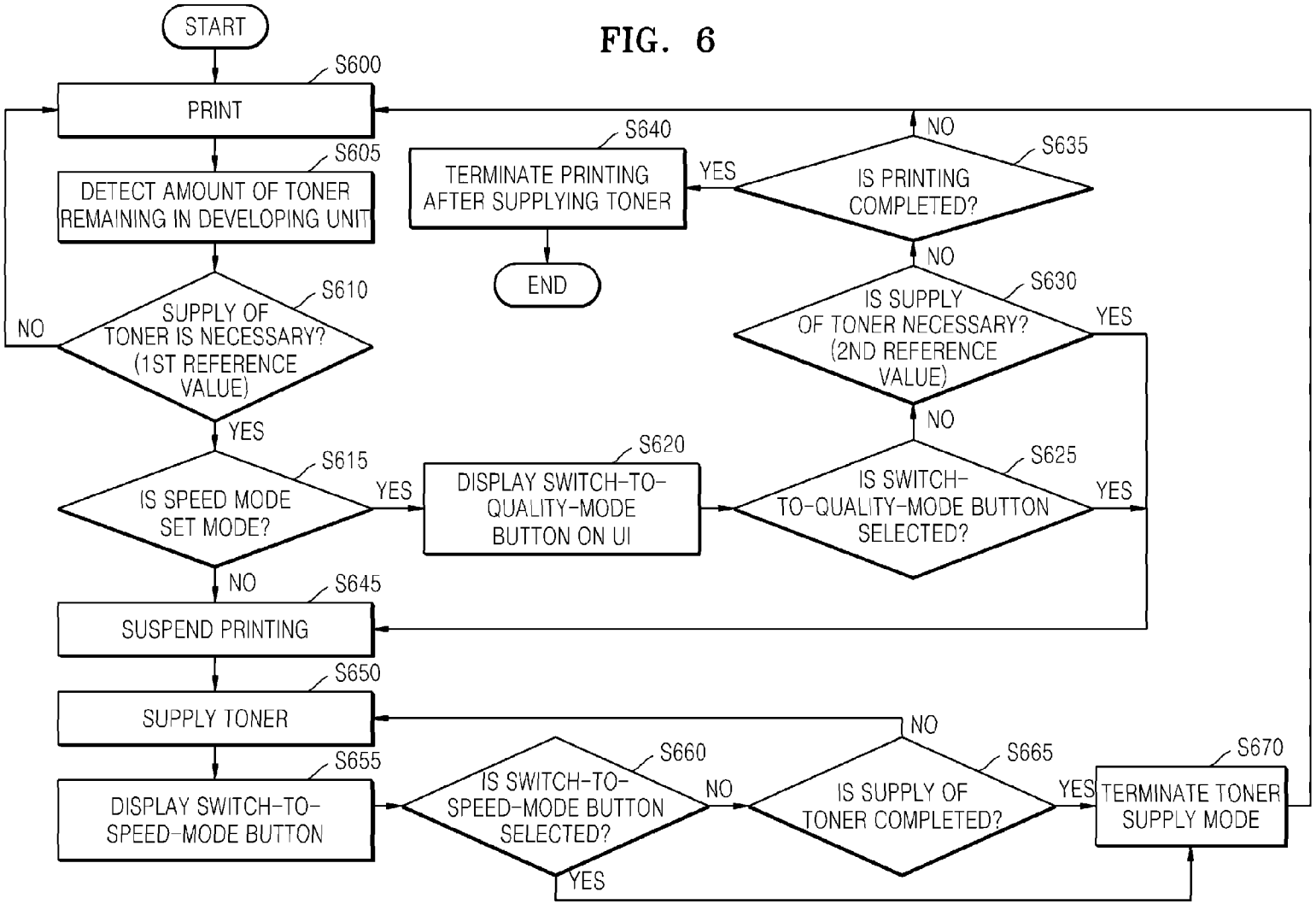
FIG. 6 is a flowchart illustrating a method of supplying toner to a developing unit in an image forming apparatus in consideration of printing quality and speed according to an embodiment.

FIG. 6 is a flowchart illustrating a method of supplying toner to a developing unit in an image forming apparatus in consideration of printing quality and speed according to embodiment. In the method, whether to operate the image forming apparatus in a toner supply mode is determined according to a user's pre-settings.

Referring to FIG. 6, in the method of supplying toner to the developing unit separate from a toner bottle, the image forming apparatus performs printing (operation S600) and detects the amount of toner remaining in the developing unit (operation S605). For example, during printing, the image forming apparatus may determine whether it is necessary to supply toner to the developing unit by using a sensor disposed in the developing unit to detect the amount of toner remaining in the developing unit.

To determine whether it is necessary to supply toner to the developing unit, a detected amount of toner remaining in the developing unit is compared with a first reference value (operation S610). That is, the remaining amount of toner is detected using the sensor and compared with a general toner supply reference value (the first reference value) so as to determine whether it is necessary to supply toner.

If the remaining amount of toner is greater than the first reference value, it is not necessary to supply the toner, and thus the image forming apparatus continues printing (operation S600).

However, if the remaining amount of toner in the developing unit is not greater than the first reference value, it is determined whether to supply toner based on a preset mode.

The preset mode includes a quality mode for supplying toner to the developing unit or a speed mode for continuing printing without supplying the toner to the developing unit.

For example, if the remaining amount of toner in the developing unit is not greater than the first reference value, it is determined whether the printing mode of the image forming apparatus is set to the speed mode to prioritize printing speed over printing quality (operation S615). That is, it is determined whether the operation mode of the image forming apparatus is set to the speed mode. The operation mode of the image forming apparatus may be an initial default mode of the image forming apparatus or may be a mode preset by a user using user interface menus.

If the operation mode of the image forming apparatus is set to the speed mode, a switch-to-quality-mode button is displayed on a screen of a user interface unit (operation S620). If the operation mode of the image forming apparatus is preset to the speed mode, the switch-to-quality-mode button may be displayed on the screen of the user interface unit of the image forming apparatus or a driver of a user's PC.

FIG. 10 illustrates an exemplary user interface screen displaying a switch-to-quality-mode button in operation S620. FIG. 10 shows a state in which printing proceeds without supplying toner, 25 sheets as a remaining number of paper sheets necessary for printing, and a switch-to-quality-mode button. In addition, it is explained that image printing quality will be improved if the operation mode of the image forming apparatus is switched to the quality mode to suspend printing and supply toner.

If a user selects the switch-to-quality-mode button displayed on the screen of the user interface unit (operation S625), printing is suspended (operation S645). That is, if a user selects the switch-to-quality-mode button in operation S620, printing is temporarily stopped, and the image forming apparatus enters into the toner supply mode. Although a user have selected the speed mode to prioritize printing speed over printing quality, if the quality of a printout is lower than expectations, the user may select the quality mode using the switch-to-quality-mode button in operation 625 so as to supply toner for obtaining a high-quality printout.

If a user does not select the switch-to-quality-mode button displayed on the screen of the user interface unit, it is determined again whether it is necessary to supply toner (operation S630). That is, it is determined whether a remaining amount of toner detected by the sensor is not greater than a second reference value smaller than the first reference value. At this time, whether to enter into the toner supply mode is determined based on a reference value (the second reference value) lower than the reference value for the remaining amount of toner used in operation S610 when the operation mode of the image forming apparatus is the speed mode. If it is necessary to supply toner, printing is temporarily stopped, and the image forming apparatus enters into the toner supply mode. At this time, the supply amount and time of toner may be smaller or shorter than the supply amount and time of toner in the quality mode.

Figure 11:
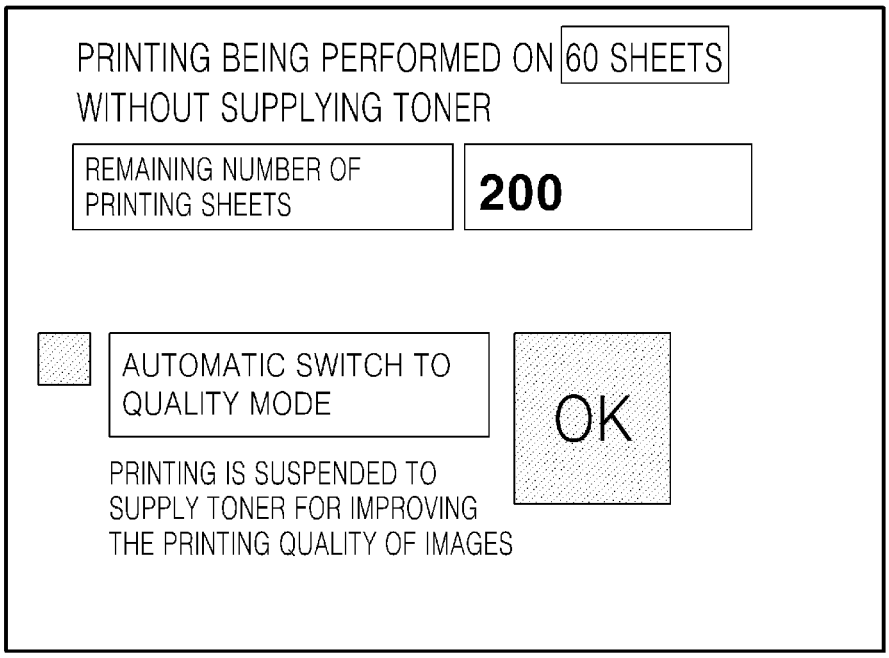
FIG. 11 illustrates an exemplary user interface screen showing a forced switch to quality mode in the middle of printing in speed mode.

FIG. 11 illustrates an exemplary user interface screen showing a forced switch to the quality mode in the middle of printing in speed mode. FIG. 11 shows a state in which 60 sheets of paper are used for printing without supplying toner and the remaining number of sheets of paper to be used for printing is 200. In addition, an automatic-switch-to-quality-mode button is displayed, and it is stated that if the automatic-switch-to-quality-mode button is checked, printing is suspended to supply toner for improving the printing quality of images.

If the remaining amount of toner is not greater than the second reference value, printing is suspended (operation S645), and toner is supplied (operation S650). In operation S630, if it is determined that the remaining amount of toner is greater than the second reference value, printing continues (operation S600). At this time, if it is determined that there is no data or image to be printed (operation S635), printing is terminated after supplying toner (operation S640). That is, before terminating printing in the speed mode, toner is supplied. In other words, the amount of toner consumed during printing in the speed mode is additionally supplied after printing, so that a user may conveniently obtain a high-quality printout in the next printing operation.

If it is determined that the printing mode of the image forming apparatus is set to the quality mode in operation S615, a user switches the printing mode of the image forming apparatus to the quality mode in operation S625, or if it is determined that it is necessary to supply toner in operation S630, printing is suspended (operation S645), and the toner is supplied to the developing unit (operation S650). At this time, a switch-to-speed-mode button is displayed on a user interface screen (operation S655). That is, a button for switching to the speed mode from the toner supply mode may be displayed on the user interface screen of the image forming apparatus and a driver of a user's PC.

Figure 9:
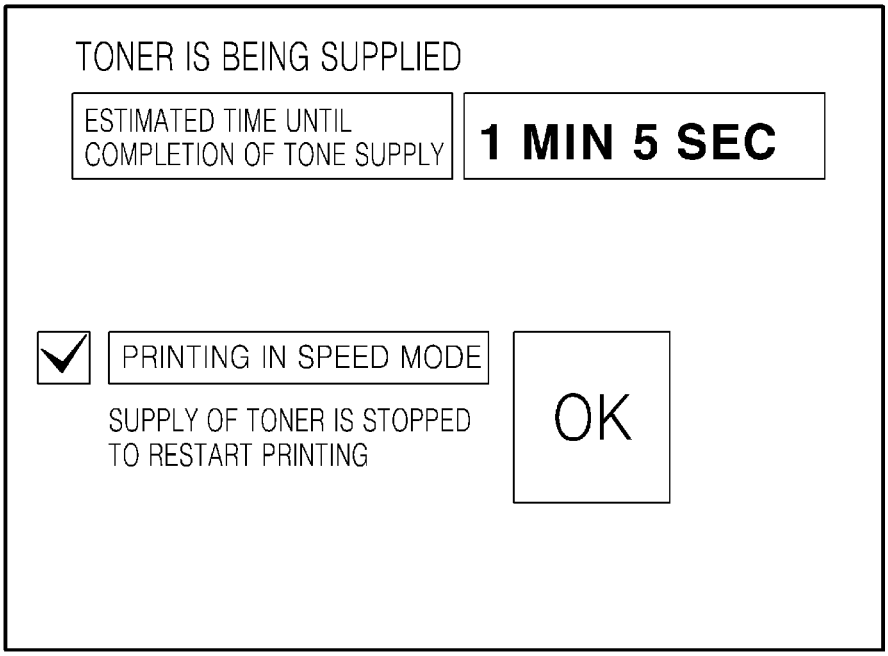
FIG. 9 illustrates an exemplary user interface screen displaying a switch-to-speed-mode button while toner is supplied to a developing unit.

FIG. 9 illustrates an exemplary user interface screen displayed in operation S655. FIG. 9 shows a state in which toner is being supplied, with a time period of 1 minute and 5 seconds estimated to be necessary until the completion of the supply of toner, and a switch-to-speed-mode button. In addition, it is stated that if the printing mode of the image forming apparatus is switched to the speed mode, supplying of the toner is stopped to restart printing.

If a user selects the switch-to-speed-mode button displayed on the user interface screen while toner is being supplied to the developing unit (operation S660), a control unit stops operation in the toner supply mode (operation S670) and restarts printing (operation S600). In operation S655, if a user selects the switch-to-speed-mode button, the operation in the toner supply mode is terminated to restart printing. This is provided for users who have not known the speed mode and the quality mode or urgently want to print documents in the middle of printing in the quality mode. Such users may conveniently stop (skip) the operation in the toner supply mode and may immediately obtain a printout.

If a user does select the switch-to-speed-mode button displayed on the user interface screen while toner is being supplied to the developing unit, it is determined whether supply of toner is completed (operation S665), and if supply of toner is completed, the operation in the toner supply mode is terminated (operation S670) to restart printing (operation S600).

Figure 7A:
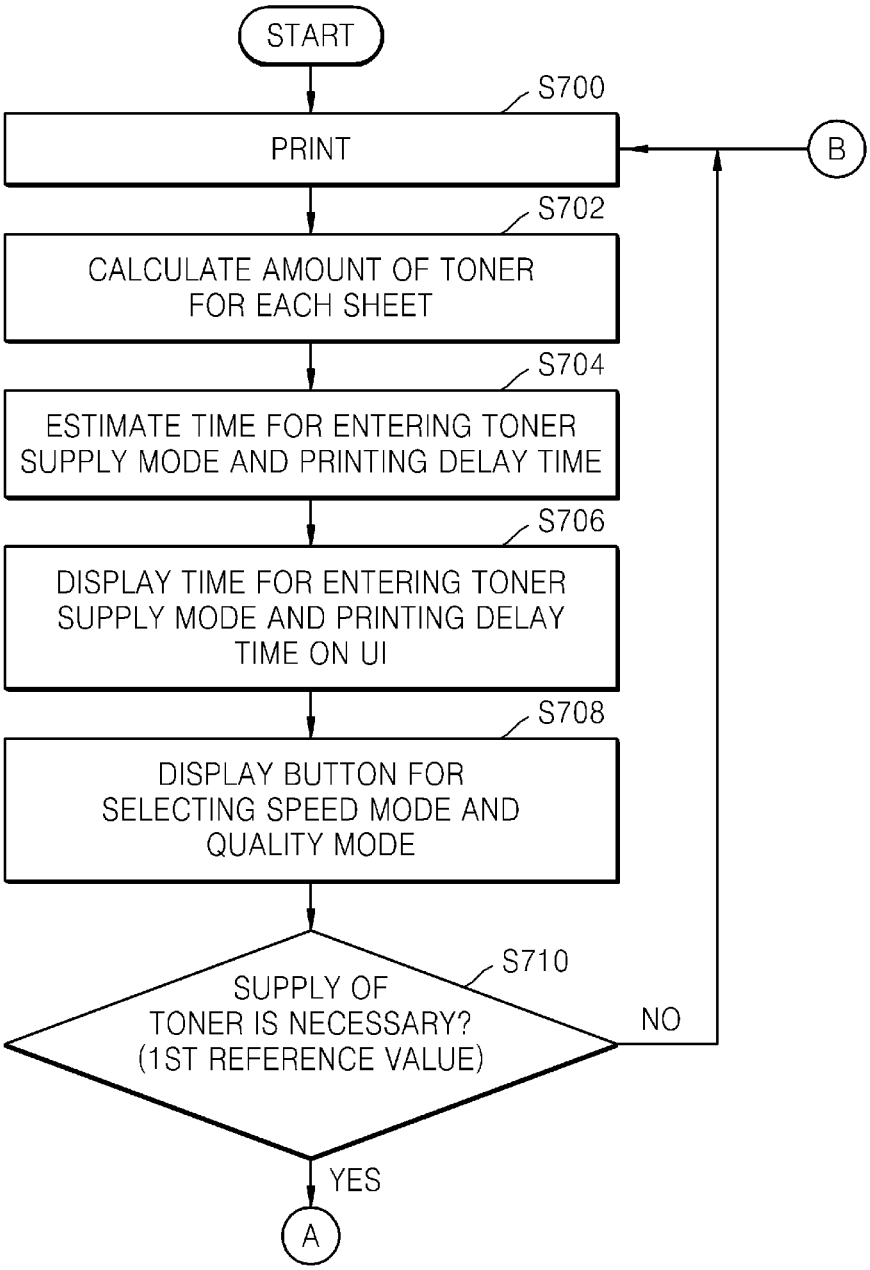
FIGS. 7A and 7B are flowcharts illustrating a method of supplying toner to a developing unit in an image forming apparatus in consideration of printing quality and speed according to an embodiment.
Figure 7B:
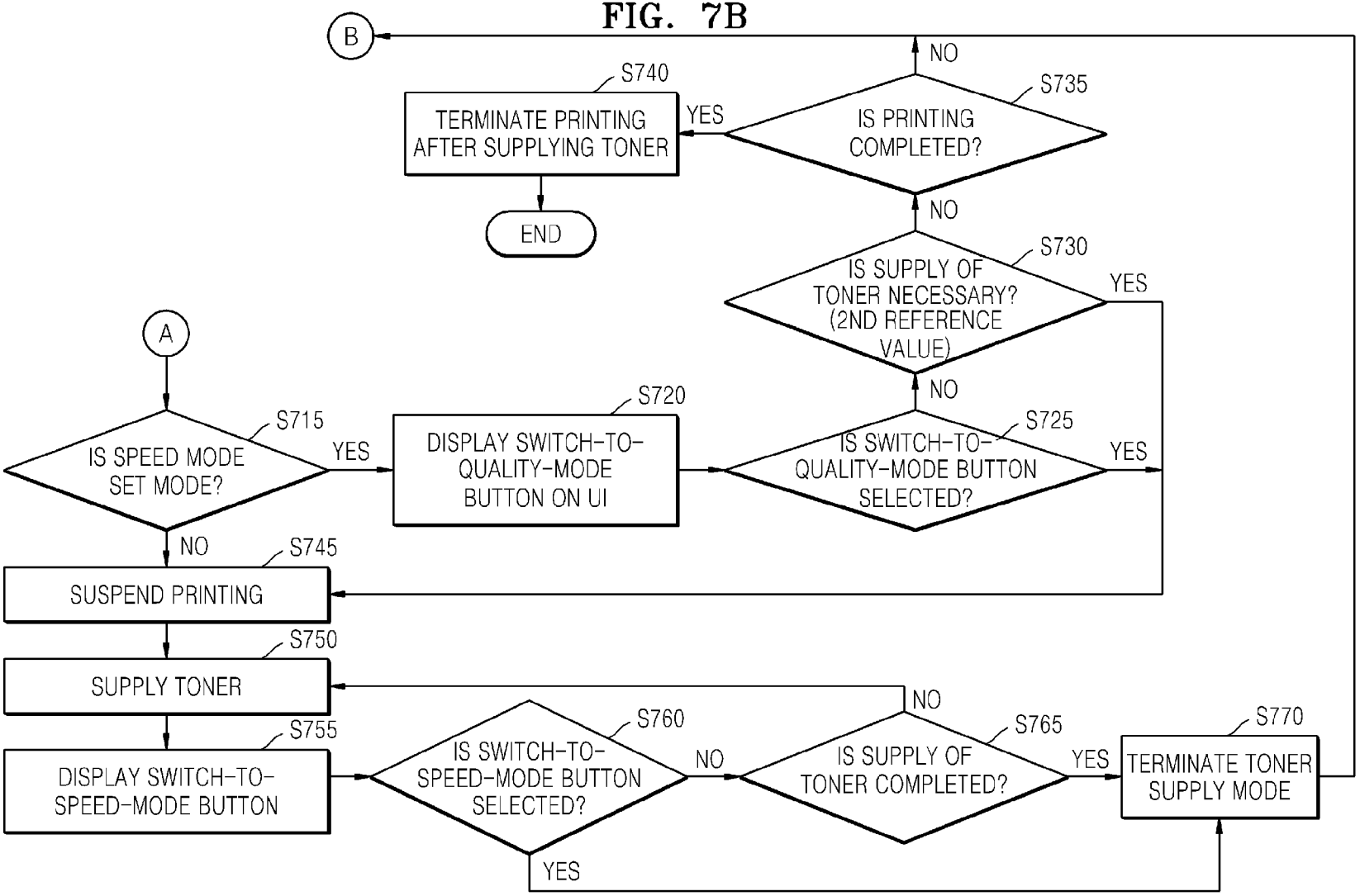

FIGS. 7A and 7B are flowcharts illustrating a method of supplying toner to a developing unit in an image forming apparatus in consideration of printing quality and speed according to an embodiment. In the method, a user may select a toner supply mode in the middle of printing before a toner supply time point.

In the method of supplying toner to the developing unit separate from a toner bottle, first, the image forming apparatus starts printing (operation S700), and then calculates the amount of toner necessary for printing on a sheet of paper (operation S702). For example, the amounts of toner used for printing sheets of paper may be added up to calculate an average amount of toner necessary for printing on each sheet of paper.

Thereafter, a time for entering into the toner supply mode and a printing delay time are estimated based on the amount of toner for each sheet of paper calculated in operation S702 and the remaining amount of toner in the developing unit (operation S704).

At this time, the number of sheets of paper that may be used for printing until the image forming apparatus enters the toner supply mode may be calculated by using Formula 1 below. In addition, the printing delay time caused by supply of toner may be estimated by using Formula 2 below.

Number of sheets of paper until entering toner supply mode=amount of toner in developing unit/average amount of toner for each sheet of paper [Formula 1]

Estimated printing delay time=time necessary for stopping printing+time for preparing toner supply mode+(supply time per unit supply amount of toner)+time necessary for stopping supply of toner+time necessary for restarting printing. [Formula 2]

The estimated time for entering the toner supply mode (or the number of sheets of paper remaining until the estimated entering time) and the estimated printing delay time necessary for supplying the toner that are calculated in operation S704 are displayed on at least one of a screen of a user interface unit of the image forming apparatus and a driver of a user's PC (operation S706).

At this time, a button is displayed on the screen (display) of the user interface unit of the image forming apparatus or the driver of the user's PC so that a user may select a speed mode in which printing continues without supplying toner by putting priority on printing speed over printing quality or a quality mode in which printing is suspended to supply toner to the developing unit according to the priority put on printing quality over printing speed (operation S708). In operations S706 and S708, a user may check information such as the time for entering the toner supply mode and the estimated printing delay time, and may select the speed mode for rapid printing or the quality mode to supply toner for high-quality printing.

Figure 8:
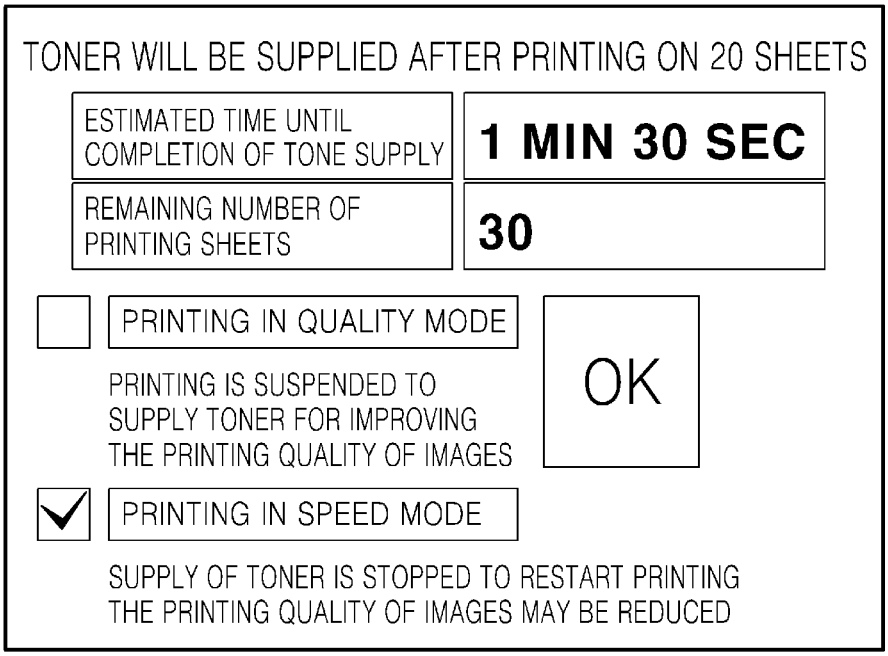
FIG. 8 is a view illustrating an exemplary screen of a user interface unit on which an estimated time for entering into toner supply mode, an estimated printing delay time, a speed mode selection button, and a quality mode selection button are displayed.

FIG. 8 is an exemplary user interface screen showing an estimated time for entering a toner supply mode, an estimated printing delay time, a speed mode button for selecting a speed mode, and a quality mode button for selecting a quality mode. Referring to FIG. 8, the estimated time for entering into the toner supply mode provides information that toner will be supplied after printing on 20 sheets of paper, and the estimated printing delay time is 1 minute and 30 seconds, i.e., the time estimated to be necessary until the completion of toner supply. In addition, the remaining number of sheets of paper necessary for printing is 30. Furthermore, it is explained that if the quality mode is selected, printing is suspended to supply the toner for improving the printing quality of images, and if the speed mode is selected, printing continues without supplying the toner in spite of the possibility of image quality deterioration. As shown in FIG. 8, if a user checks the speed mode button, printing proceeds in the speed mode. That is, as it gets closer to a time point for starting supply of the toner, an estimated time necessary for supplying the toner in the toner supply mode is displayed on the user interface screen in the form of a remaining time, and according to the remaining amount of printing, a user may select the quality mode for supplying the toner or the speed mode for printing without supplying the toner. At this time, if a user does not select any one of the quality mode and the speed mode, the image forming apparatus may enter the quality mode.

Thereafter, the remaining amount of toner in the developing unit is detected during printing, and the remaining amount of toner is compared with a first reference value (operation S710). If the remaining amount of toner is greater than the first reference value, printing continues.

If the remaining amount of toner in the developing unit is not greater than the first reference value, it is determined whether to supply toner based on a preset set mode. For example, when the remaining amount of toner is not greater than the first reference value, the preset mode may be the quality mode (toner is supplied to the developing unit) or may be the speed mode (printing is continued without supplying toner to the developing unit). The preset mode may be an initial default mode of the image forming apparatus or a mode set by a user. For example, if the remaining amount of toner in the developing unit is not greater than the first reference value, it is determined whether the printing mode of the image forming apparatus is the speed mode or the quality mode (operation S715). If the printing mode of the image forming apparatus is the speed mode, printing continues.

Thereafter, it is determined whether a remaining amount of toner detected by a sensor is not greater than a second reference value that is smaller than the first reference value. If the remaining amount of toner is not greater than the second reference value, printing is suspended so as to supply toner.

In operation S715, if it is determined that the printing mode of the image forming apparatus is set to the speed mode, a printing mode switch button may be displayed to allow switching to the quality mode in which printing quality has priority over printing speed. If the printing mode switch button is selected, printing may be suspended, and a switch-to-speed-mode button may be displayed on the user interface screen while supplying toner to the developing unit. After the switch-to-speed-mode button is displayed, if a user selects the switch-to-speed-mode button, supplying of the toner to the developing unit is suspended to restart printing.

The next operations after operation S710 are the same as the operations after operation S610. That is, if the remaining amount of toner in the developing unit is not greater than the first reference value, it is determined whether the printing mode of the image forming apparatus is set to the speed mode to prioritize printing speed over printing quality (operation S715).

If the operation mode of the image forming apparatus is set to the speed mode, a switch-to-quality-mode button is displayed on the user interface screen (operation S720). If the operation mode of the image forming apparatus is preset to the speed mode, the switch-to-quality-mode button may be displayed on the user interface screen of the image forming apparatus or the driver of the user's PC.

FIG. 10 illustrates an exemplary user interface screen displaying a switch-to-quality-mode button in operation S720. FIG. 10 shows a state in which printing proceeds without supplying toner, with a remaining number of paper sheets necessary for printing being 25, and a switch-to-quality-mode button. In addition, it is explained that image printing quality will be improved if the operation mode of the image forming apparatus is switched to the quality mode to suspend printing and supply toner.

If a user selects the switch-to-quality-mode button displayed on the user interface screen (operation S725), printing is suspended (operation S745). That is, if a user selects the switch-to-quality-mode button in operation S720, printing is temporarily stopped, and the image forming apparatus enters the toner supply mode. Although a user has selected the speed mode to prioritize printing speed over printing quality, if the quality of a printout is lower than expected, the user may select the quality mode using the switch-to-quality-mode button in operation 725 so as to supply toner for obtaining a high-quality printout.

If a user does not select the switch-to-quality-mode button displayed on the user interface screen, it is determined again whether it is necessary to supply toner (operation S730). That is, it is determined whether a remaining amount of toner detected by the sensor is not greater than a second reference value that is smaller than the first reference value. At this time, whether to supply toner is determined based on a reference value (the second reference value) lower than the reference value for the remaining amount of toner used in operation S710 when the operation mode of the image forming apparatus is the speed mode. If it is necessary to supply toner, printing is temporarily stopped, and the image forming apparatus enters the toner supply mode. At this time, the supply amount and supply time period of toner may be smaller or shorter than the supply amount and supply time period of toner in the quality mode.

FIG. 11 illustrates an exemplary user interface screen showing a forced switch to a quality mode in the middle of printing in speed mode. FIG. 11 shows a state of printing on 60 sheets of paper without supplying toner, with a remaining number of sheets of paper being 200. In addition, an automatic-switch-to-quality-mode button is displayed, and it is stated that if the automatic-switch-to-quality-mode button is checked, printing is suspended so as to supply toner for improving the printing quality of images.

If the remaining amount of toner is not greater than the second reference value, printing is suspended (operation S745) so as to supply toner (operation S750). In operation S730, if it is determined that the remaining amount of toner is greater than the second reference value, printing continues (operation S700). At this time, if it is determined that there is no data or image to be printed (operation S735), printing is terminated after supplying the toner (operation S740). That is, before terminating printing in the speed mode, the toner is supplied. In other words, the amount of toner consumed during printing in the speed mode is additionally supplied after printing, so that a user may conveniently obtain a high-quality printout in the next printing operation without inconvenience.

If it is determined that the printing mode of the image forming apparatus is set to the quality mode in operation S715, a user switches the printing mode of the image forming apparatus to the quality mode in operation S725, or if it is determined that it is necessary to supply toner in operation S730, printing is suspended (operation S745), and toner is supplied to the developing unit (operation S750). At this time, the switch-to-speed-mode button is displayed on a user interface screen (operation S755). That is, a button for switching to the speed mode from the toner supply mode may be displayed on the user interface screen of the image forming apparatus and the driver of the user's PC.

FIG. 9 illustrates an exemplary user interface screen displayed in operation S755. FIG. 9 shows a state in which toner is being supplied, with a time period of 1 minute and 5 seconds estimated to be necessary until supplying of the toner is completed, and a switch-to-speed-mode button. In addition, it is stated that if the printing mode of the image forming apparatus is switched to the speed mode, supplying of the toner is stopped to restart printing.

If a user selects the switch-to-speed-mode button displayed on the user interface screen while toner is being supplied to the developing unit (operation S760), a control unit stops operation in the toner supply mode (operation S770) and restarts printing (operation S700). In operation S755, if a user selects the switch-to-speed-mode button, the operation in the toner supply mode is terminated to restart printing. This is provided for users who are unaware of the speed mode and the quality mode or urgently want to print documents when in the middle of printing in the quality mode. Such users may conveniently stop (skip) the operation in the toner supply mode and may immediately obtain a printout.

If a user does select the switch-to-speed-mode button displayed on the user interface screen while toner is being supplied to the developing unit, it is determined whether supplying of the toner is completed (operation S765), and if supplying of the toner is completed, the operation in the toner supply mode is terminated (operation S770) to restart printing (operation S700).

As described above, according to the one or more of the above embodiments, the method of supplying toner to a developing unit, and the image forming apparatus including a developing unit supplied with toner by the method are provided to reduce printing performance deterioration in the toner supply mode based on a user's settings. That is, if the sensor disposed in the developing unit detects consumption of toner, the image forming apparatus may enter into the toner supply mode during printing. In this case, the image forming apparatus may enter the toner supply mode without suspending printing, and thus the printing performance thereof may not be deteriorated. In addition, when high-coverage images consuming a large amount of toner filled in the developing unit are printed, the image forming apparatus may enter the toner supply mode less frequently, and thus the printing performance thereof may not be lowered.

Processes, functions, methods, and/or software in apparatuses described herein may be recorded, stored, or fixed in one or more non-transitory computer-readable media (computer readable storage (recording) media) that includes program instructions (computer readable instructions) to be implemented by a computer to cause one or more processors to execute (perform or implement) the program instructions. The media may also include, alone or in combination with the program instructions, data files, data structures, and the like. The media and program instructions may be those specially designed and constructed, or they may be of the kind well-known and available to those having skill in the computer software arts. Examples of non-transitory computer-readable media include magnetic media, such as hard disks, floppy disks, and magnetic tape; optical media such as CD ROM disks and DVDs; magneto-optical media, such as optical disks; and hardware devices that are specially configured to store and perform program instructions, such as read-only memory (ROM), random access memory (RAM), flash memory, and the like. Examples of program instructions include machine code, such as produced by a compiler, and files containing higher level code that may be executed by the computer using an interpreter. The program instructions may be executed by one or more processors. The described hardware devices may be configured to act as one or more software modules that are recorded, stored, or fixed in one or more non-transitory computer-readable media, in order to perform the operations and methods described above, or vice versa. In addition, a non-transitory computer-readable medium may be distributed among computing devices connected through a network and program instructions may be stored and executed in a decentralized manner. In addition, the computer-readable media may also be embodied in at least one application specific integrated circuit (ASIC) or Field Programmable Gate Array (FPGA).

It should be understood that the exemplary embodiments described herein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the spirit and scope of the present disclosure as defined by the following claims.

What is claimed is:

1. A method of supplying toner to a developing unit separate from a toner bottle in an image forming apparatus, the method comprising:

calculating an amount of toner necessary for each sheet of paper;

calculating a time for entering a toner supply mode and an estimated printing delay time based on a remaining amount of toner in the developing unit and the calculated amount of toner for each sheet of paper;

displaying the calculated time for entering the toner supply mode or a number of sheets of paper to be used until the calculated time for entering the toner supply mode, and the estimated printing delay time, on a screen of a user interface unit of the image forming apparatus;

displaying a button for selecting one of a speed mode in which printing is continued without additionally supplying toner and a quality mode in which toner is supplied, on the screen of the user interface unit of the image forming apparatus;

detecting the remaining amount of toner in the developing unit during printing so as to compare the detected remaining amount of toner with a first reference value; and if the detected remaining amount of toner is greater than the first reference value, continuing printing, and if the detected remaining amount of toner is not greater than the first reference value, determining whether to supply toner to the developing unit based on a selected mode when one of the speed mode and the quality mode is selected by a user, wherein when the quality mode is selected by the user and toner is being supplied in the quality mode, an estimated time until completion of a supply of toner and a switch-to-speed-mode button are displayed on the user interface screen, and when the switch-to-speed-mode button is clicked by the user, the supply of toner is suspended in a forced manner and printing is continued regardless of the remaining amount of toner, and when the speed mode is selected by the user and printing is executed without supplying toner, a remaining number of paper sheets necessary for printing and a switch-to-quality mode button are displayed on the user interface screen, and when the switch-to-quality mode button is clicked by the user, printing is suspended in a forced manner and toner is supplied to improve printing quality regardless of the remaining amount of toner.

2. The method of claim 1, further comprising:

determining whether the remaining amount of toner detected by a sensor is not greater than a second reference value that is smaller than the first reference value; and if the remaining amount of toner detected by the sensor is not greater than the second reference value, suspending printing and supplying toner.

3. An image forming apparatus comprising:

an image forming unit configured to form images on printing media;

a toner bottle disposed in the image forming unit;

a developing unit separate from the toner bottle and configured to receive toner from the toner bottle for developing images;

a user interface unit which provides a user interface; and a control unit configured to compare a remaining amount of toner in the developing unit with a first reference value, wherein if the remaining amount of toner in the developing unit is greater than the first reference value, the control unit signals the image forming unit to continue printing, and if the remaining amount of toner in the developing unit is not greater than the first reference value, the control unit determines whether to supply toner based on a selected mode when one of a speed mode in which printing is continued without additionally supplying toner and a quality mode in which toner is supplied is selected by a user, wherein the control unit calculates an amount of toner necessary for each sheet of paper, calculates a time for entering a toner supply mode, a number of sheets of paper to be used for printing, and a printing delay time based on the remaining amount of toner in the developing unit and the calculated amount of toner necessary for each sheet of paper, and displays the time for entering the toner supply mode, the number of sheets of paper to be used for printing, and the printing delay time on the user interface unit, and wherein the user interface unit displays a button to select one of the speed mode in which printing is continued without additionally supplying toner and the quality mode in which toner is supplied, wherein when the quality mode is selected by the user and toner is being supplied in the quality mode, the control unit displays an estimated time until completion of a supply of toner and a switch-to-speed-mode button on a user interface screen, and when the switch-to-speed-mode button is clicked by the user, the control unit suspends the supply of toner in a forced manner and continues printing regardless of the remaining amount of toner, and when the speed mode is selected by the user and printing is executed without supplying toner, the control unit displays a remaining number of paper sheets necessary for printing and a switch-to-quality mode button on the user interface screen, and when the switch-to-quality mode button is clicked by the user, the control unit suspends printing in a forced manner and toner is supplied to improve printing quality regardless of the remaining amount of toner.

4. The image forming apparatus of claim 3, wherein the control unit determines whether the remaining amount of toner in the developing unit is not greater than a second reference value that is smaller than the first reference value, and if the remaining amount of toner of the developing unit is not greater than the second reference value, the control unit signals the image forming unit to suspend printing to supply toner to the developing unit.

5. The image forming apparatus of claim 4, further comprising a printing mode storage unit storing information about printing mode settings.

6. The image forming apparatus of claim 3, wherein if a number of sheets of paper used for printing in a speed mode is equal to or greater than a predetermined value, the control unit supplies toner to the developing unit.

7. The image forming apparatus of claim 3, wherein the control unit calculates an amount of toner used in a speed mode, and if the amount of toner used in the speed mode is equal to or greater than a predetermined value, the control unit supplies toner to the developing unit.

8. The image forming apparatus of claim 3, wherein if the remaining amount of toner in the developing unit during operation in a speed mode is equal to or smaller than a predetermined value, the control unit supplies toner to the developing unit.

* * * * *